US006602830B1

(12) United States Patent
Fey et al.

(10) Patent No.: US 6,602,830 B1
(45) Date of Patent: Aug. 5, 2003

(54) TRACTIONS FLUIDS HAVING EXCELLENT LOW TEMPERATURE PROPERTIES

(75) Inventors: Kenneth Christopher Fey, Midland, MI (US); Glenn Frederick Viaplana Gordon, Midland, MI (US); Terrence Keith Hilty, Midland, MI (US); Russell Keith King, Midland, MI (US); Tina Marie Leaym, Saginaw, MI (US); Gary Michael Wieber, Midland, MI (US); Eugene Dale Groenhof, Freeland, MI (US)

(73) Assignee: Dow Corning Corporation, Midland, MI (US)

( * ) Notice: Subject to any disclaimer, the term of this patent is extended or adjusted under 35 U.S.C. 154(b) by 0 days.

(21) Appl. No.: 10/036,006

(22) Filed: Dec. 28, 2001

(51) Int. Cl.[7] ..... C10M 107/50; C10M 155/02
(52) U.S. Cl. ..... 508/208; 252/78.3
(58) Field of Search ..... 508/208

(56) References Cited

U.S. PATENT DOCUMENTS

| | | | | |
|---|---|---|---|---|
| 4,190,546 A | 2/1980 | Kulik et al. | ..... | 252/49.6 |
| 4,449,415 A | 5/1984 | Groenhof | ..... | 74/214 |
| 5,109,095 A | 4/1992 | Butler | ..... | 528/15 |
| 5,583,095 A | 12/1996 | Kobayashi et al. | ..... | 508/207 |
| 5,629,273 A * | 5/1997 | Hauenstein | ..... | 508/208 |

FOREIGN PATENT DOCUMENTS

| | | | |
|---|---|---|---|
| EP | 0102088 | 3/1984 | |
| EP | 0143462 | 6/1985 | |
| EP | 0240814 A2 | 10/1987 | ..... C10M/111/00 |
| EP | 0350125 | 1/1990 | |
| EP | 0389138 | 9/1990 | |
| JP | 93230482 | 9/1993 | |
| JP | 93247481 | 9/1993 | |
| JP | 93255681 | 10/1993 | |
| JP | 01234185 A | 8/2001 | |
| JP | 2001342477 | 12/2001 | |
| WO | WO 91/13133 | 9/1991 | ..... C10M/135/00 |

* cited by examiner

*Primary Examiner*—Ellen M. McAvoy
(74) *Attorney, Agent, or Firm*—Patricia M. Scaduto

(57) ABSTRACT

Traction fluids suitable for operations under widely varying temperature environments, particularly having excellent low temperature properties are described. The tractions fluids comprise blends of organic oils and siloxane compositions. The siloxane compositions may include MTQ, MT, MQ, MDT, MDM, or D units in varying molar percents.

16 Claims, No Drawings

TRACTIONS FLUIDS HAVING EXCELLENT LOW TEMPERATURE PROPERTIES

FIELD OF THE INVENTION

This invention relates to traction fluids suitable for operations under widely varying temperature environments, particularly having excellent low temperature properties. The tractions fluids of this invention comprise blends of organic oils and siloxane compositions. The siloxane compositions may include MTQ, MT, MQ, MDT, MDM, or D units in varying molar percents.

BACKGROUND OF THE INVENTION

Traction is broadly defined as the adhesive friction of a body on a surface on which it moves. A traction drive is a device in which torque is transmitted from an input element to an output element through nominal point or line contact typically with a rolling action by virtue of the traction between the contacting elements.

While traction elements are commonly spoken of as being in contact, it is generally accepted that a fluid film is present therebetween. Almost all traction drives require these fluids, known as traction fluids, to remove heat, to prevent wear at the contact surfaces and to lubricate bearings and other moving parts associated with the drive. Thus, instead of metal to metal rolling contact there is a film of fluid introduced into the contact zone and interposed between the metal elements. High pressures and high shear conditions are found in this area of contact between the roller elements and so the nature of this traction fluid determines to a large extent the limits of performance and the capacity of the drive. It is through the traction fluid's resistance to shear that the torque transmitting ability of a given fluid arises. The torque transmitting ability of a fluid, and thus its suitability as a traction fluid, is measured by and is directly related to its traction coefficient.

Most commercial traction fluids are organic oils although they will also contain other additives useful for reducing wear etc. Unfortunately, these organic oils tend to get very viscous at low temperatures. Since traction fluids are most useful when they can perform over a wide temperature range, attempts have been made to blend these organic oils with various materials in an attempt to widen the range of temperatures in which they can Most commercial traction fluids are organic oils although they will also contain other additives useful for reducing wear etc. Unfortunately, these organic oils tend to get very viscous at low temperatures. Since traction fluids are most useful when they can perform over a wide temperature range, attempts have been made to blend these organic oils with various materials in an attempt to widen the range of temperatures in which they can operate. Unfortunately, while improvements have been made, the previous blends have not provided all the necessary properties at low temperatures.

It is an object of this invention to provide traction fluids suitable for operations under widely varying temperature environments, particularly having excellent low temperature properties.

SUMMARY OF THE INVENTION

The present invention relates to traction fluids comprising (A) 15 to 99 weight percent of at least one organic oil and (B) 1 to 85 weight percent of at least one siloxane composition chosen from units of formulae (I) $(R_3SiO_{1/2})(RSiO_{3/2})(SiO_{4/2})$, (MTQ units)

(II) $(R_3SiO_{1/2})(RSiO_{3/2})$, (MT units)

(III) $(R_3SiO_{1/2})(SiO_{4/2})$, (MQ units)

(IV) $(R_3SiO_{1/2})(R_2SiO_{2/2})(RSiO_{3/2})$, (MDT units)

(V) $(R_3SiO_{1/2})(R_2SiO_{2/2})$, and (MD units)

(VI) $(R_2SiO_{2/2})_a$ (D units)

in varying mole percents, where a is an integer ranging from 3 to 20 and each R is independently selected from alkyl groups comprising 1 to 18 carbon atoms and aryl groups comprising 6 to 18 carbon atoms.

DETAILED DESCRIPTION OF THE INVENTION

The present invention is a traction fluid comprising (A) 15 to 99 weight percent of at least one organic oil; and (B) 1 to 85 weight percent of at least one siloxane composition chosen from (I) 33 to 80 mole percent units of formula $(R_3SiO_{1/2})$, 0.2 to 66.8 mole percent units of formula $(RSiO_{3/2})$, and 66.8 to 0.2 mole percent units of formula $(SiO_{4/2})$ having a viscosity of from 1.0 to 50,000 mPa.s at 40° C., where each R is independently selected from alkyl groups comprising 1 to 18 carbon atoms and aryl groups comprising 6 to 18 carbon atoms provided from 10 to 70 mole percent of R groups are not methyl;

(II) 33 to 75 mole percent units of formula $(R_3SiO_{1/2})$ and 67 to 25 mole percent units of formula $(RSiO_{3/2})$ having a viscosity of from 2.0 to 20,000 mPa.s at 40° C., where each R is independently selected from alkyl groups comprising 1 to 18 carbon atoms and aryl groups comprising 6 to 18 carbon atoms provided from 10 to 70 mole percent of R groups are not methyl;

(III) 33 to 80 mole percent units of formula $(R_3SiO_{1/2})$ and 67 to 20 mole percent units of formula $(SiO_{4/2})$ having a viscosity of from 1.0 to 70,000 mPa.s at 40° C., where each R is independently selected from alkyl groups comprising 1 to 18 carbon atoms and aryl groups comprising 6 to 18 carbon atoms provided from 10 to 70 mole percent of R groups are not methyl;

(IV) 0 to 28 mole percent units of formula $(R_3SiO_{1/2})$, 37 to 93 mole percent units of formula $(R_2SiO_{2/2})$, and 6 to 56 mole percent units of formula $(RSiO_{3/2})$ having a viscosity of from 5.0 to 10,000 mPa.s at 40° C., where each R is independently selected from alkyl groups comprising 1 to 18 carbon atoms and aryl groups comprising 6 to 18 carbon atoms provided from 10 to 70 mole percent of R groups are not methyl and provided further that at least one of the R groups which is not methyl is chosen from alkyl groups comprising 7 to 18 carbon atoms and aryl groups comprising 7 to 18 carbon atoms;

(V) 1 to 100 mole percent units of formula $(R_3SiO_{1/2})$ and 99 to 0 mole percent units of formula $(R_2SiO_{2/2})$ having a viscosity of from 1.0 to 50,000 mPa.s at 40° C., where each R is independently selected from alkyl groups comprising 1 to 18 carbon atoms and aryl groups comprising 6 to 18 carbon atoms provided from 10 to 70 mole percent of R groups are not methyl and provided further that at least one of the R groups which is not methyl is chosen from alkyl groups comprising 7 to 18 carbon atoms and aryl groups comprising 7 to 18 carbon atoms; and (VI) cyclosiloxanes of formula $(R2SiO_{2/2})_a$ having a viscosity of from 2.0 to 50,000 mPa.s at 40° C., where a is an integer ranging from 3 to 20, each R is independently selected from alkyl groups comprising 1 to 18 carbon atoms and aryl groups comprising 6 to 18 carbon atoms provided from 10 to 70 mole percent of R groups are not methyl.

The traction fluids useful in the present method comprise (A) 15 to 99 weight percent of at least one organic oil; and (B) 1 to 85 weight percent of at least one siloxane composition chosen from (I)–(VI) described above.

Component (A) comprises at least one organic oil. The term "organic" as used herein means materials comprising carbon chains or rings and the substituents bonded to those carbon chains or rings may include hydrogen atoms, oxygen, and nitrogen where the oxygen and nitrogen may also be part of the carbon chain. Examples of organic oils included in this definition are hydrocarbons such as alicyclic materials and linear hydrocarbon polymers; oxygen-containing materials such as ethers, esters, ketones, and acids; and nitrogen-containing materials such as amines, amides, and ureas.

The alicyclic materials can include saturated fused rings, saturated rings joined by a divalent group, and saturated rings linked directly to each other but not fused. The materials are commercially available or may be prepared by methods known in the art.

Examples of alicyclic materials include bis-decalin, as described in JP 61-004796; tetramethyldecalin, as described in JP 63-222128 and U.S. Pat. No. 3,803,037; cyclohexyl-substituted indanes, as described in JP 63-063789; fluorene, also described in JP 63-063789; acenaphthene, as described in EP 269,089 and JP 71-33235; hydrogenated naphthalene, as described in EP 240,814; dicyclohexyl alkanes, as described in JP 61-100533 and U.S. Pat. No. 3,966,624); 2,4 dicyclohexyl-2-methylpentane, as described in U.S. Pat. No. 3,975,278; hydrogenated dimers of camphene, as described in EP 305,807; bis-methyl substituted norbornyl methane, as described in EP 968,987 and U.S. Pat. No. 5,126,065; bis-methyl substituted bicyclooctyl methane, as described in U.S. Pat. No. 5,422,027 and EP 402,881; adamantanes, as described in U.S. Pat. No. 5,369,213; saturated addition polymers derived from dicyclopentadiene; saturated polycyclopentadiene resins with cyclohexyl butanes; bis-(trimethylcyclohexyl) methane, such as described in EP 361,347; polycyclopentadiene, such as described in JP 3,103,495; copolymers of cyclopentadiene and butadiene, such as described in EP 989,177; hydrogenated naphthenic oils; and hydrogenated terphenyls, such as described in EP 269,020.

Examples of linear hydrocarbon polymers include unsaturated and hydrogenated polybutene and polyisobutylene (PIB); polypropylene, such as described in JP 2-158689; polyalphaolefins ($C_{5-10}$), such as described in U.S. Pat. No. 3,966,624; hydrogenated isoprene polymers, such as described in U.S. Pat. No. 4,762,635; hydrogenated terpene dimers and trimers, such as described in U.S. Pat. No. 4,922,047; and mineral oils.

Examples of oxygen-containing organic materials include esters of cyclohexyl carboxylic acid and cyclohexanol, such as described in U.S. Pat. No. 4,871,476; esters of cyclohexyl carboxylic acid and polyols, such as described in JP 62-153393 and WO 8,707,635; esters of dicyclohexyldicarboxylic acids, such as described in JP 62-177098; and cyclohexyl-containing ketones, such as described in JP 9-188888.

Examples of nitrogen-containing organic materials include amides and ureas, such as described in JP 72-58669; and cyclohexyl amines, such as described in JP 9-188888.

Preferred organic oils of Component (A) are unsaturated polybutene, unsaturated polyisobutylene, hydrogenated polyisobutylene; 2,4 dicyclohexyl-2-methylpentane, bis-methyl substituted norbornyl methane; esters of cyclohexyl carboxylic acid and cyclohexanol; esters of cyclohexyl carboxylic acid and polyols; and esters of cyclohexanol and dicarboxylic acids.

More preferred organic oils of Component (A) are hydrogenated polyisobutylene; 2,4 dicyclohexyl-2-methylpentane; and bis-methyl substituted norbornyl methane.

Generally, 15 to 99 weight percent of Component (A) may be used in the present invention. Preferably, 22 to 90 weight percent of Component (A) may be used, with 30 to 75 weight percent of Component (A) being more preferable. Component (A) comprises at least one organic oil as described above. Therefore, Component (A) may be one organic oil or a blend of two or more organic oils.

As described above, the organic oils of Component (A) are commercially available or may be made by methods known in the art. Examples of such methods include Diels-Alder reactions, cationic polymerization, and hydrogenation.

Component (B) comprises at least one siloxane composition chosen from (I)–(VI) described above. Preferably, Component (B) comprises at least one siloxane composition chosen from (II), (III), (IV), (V), and (VI), more preferably (II), (III), and (VI). Most preferably, Component (B) comprises at least one siloxane composition chosen from (II) and (VI). The siloxane compositions described above may contain monofunctional siloxane units (M units) represented by formula ($R_3SiO_{1/2}$), difunctional siloxane units (D units) represented by formula ($R_2SiO_{2/2}$), trifunctional siloxane units (T units) represented by formula ($RSiO_{3/2}$), and tetrafunctional siloxane units (Q units) represented by formula ($SiO_{4/2}$).

Each R in siloxane compositions (I)–(VI) is independently selected from alkyl groups comprising 1 to 18 carbon atoms and aryl groups comprising 6 to 18 carbon atoms. The alkyl groups of R can be linear, branched and cyclic. Examples of linear alkyl groups include methyl, ethyl, propyl, butyl, pentyl, hexyl, heptyl, octyl, decyl, and octadecyl. Examples of branched alkyl groups include isobutyl, tertiary butyl, 2-ethylhexyl, 2,4,4,6,6-pentamethylheptyl and 2,4,4-trimethylpentyl. The cyclic groups may be attached directly to the silicon atom or attached through a divalent hydrocarbon group. Preferably, the divalent hydrocarbon group is an alkylene group. In addition, the cyclic groups may have hydrocarbon groups attached to the ring. Examples of cyclic alkyl groups include cyclobutyl, cyclopentyl, cyclohexyl, methylcyclohexyl, dimethylcyclohexyl, 2-cyclohexylethyl, 2-cyclohexylpropyl, cyclooctyl, bicyclo (2.2.1) heptyl, bicyclo (2.2.2) octyl, methylnorbornyl ethylnorbornyl, trimethylnorbomyl, 2-norbomylethyl and decanyl.

The aryl groups of R maybe attached directly to the silicon atom or attached through a divalent hydrocarbon group. Preferably, the divalent hydrocarbon group is an alkylene group. In addition, the aryl groups may have hydrocarbon groups attached to the aromatic ring. Examples of the aryl radicals comprising 6 to I 8 carbon atoms include phenyl, benzyl, tolyl, xylyl, 2-phenyl-2-methylethyl, naphthyl, methylnaphthyl, ethylnaphthyl, 2-naphthylethyl, and 2-phenylethyl.

Preferably, each R is independently selected from linear alkyl groups having from 1 to 8 carbon atoms, branched alkyl groups comprising 4 to 18 carbon atoms, and cyclic alkyl groups comprising 5 to 18 carbon atoms. More preferably, each R is independently selected from methyl, cyclohexyl, 2,4,4-trimethylpentyl, and norbornyl.

Siloxane composition (I) contains 33 to 80 mole percent siloxane units of formula ($R_3SiO_{1/2}$) (M units), 0.2 to 66.8 mole percent siloxane units of formula ($RSiO_{3/2}$) (T units), and 66.8 to 0.2 mole percent siloxane units of formula ($SiO_{4/2}$) (Q units) having a viscosity of from 1.0 to 50,000 mPa.s at 40° C., where each R is independently selected from alkyl groups comprising 1 to 18 carbon atoms and aryl groups comprising 6 to 18 carbon atoms provided from 10 to 70 mole percent of R groups are not methyl. Examples of R are as described above. Although siloxane composition (I) generally contains M units, T units, and Q units in each molecule, so long as it doesn't affect the object of the invention, siloxane composition (I) may also contain difunctional siloxane units (D units) represented by formula ($R_2SiO_{2/2}$).

Siloxane composition (II) contains 33 to 75 mole percent siloxane units of formula ($R_3SiO/_{1/2}$) (M units) and 67 to 25 mole percent siloxane units of formula ($RSiO_{3/2}$) (T units) having a viscosity of from 2.0 to 20,000 mPa.s at 40° C., where each R is independently selected from alkyl groups comprising 1 to 18 carbon atoms and aryl groups comprising 6 to 18 carbon atoms provided from 10 to 70 mole percent of R groups are not methyl. Examples of R are as described above.

Preferably, siloxane composition (II) contains 33 to 67 mole percent M units and 67 to 33 mole percent T units having a viscosity of from 5.0 to 20,000 mPa.s at 40° C., where each R is independently selected from linear alkyl groups comprising 1 to 8 carbon atoms, branched alkyl groups comprising 4 to 18 carbon atoms, and cyclic alkyl groups comprising 5 to 18 carbon atoms provided from 15 to 60 mole percent of R groups are not methyl.

More preferably, siloxane composition (II) contains 50 to 67 mole percent M units and 50 to 33 mole percent T units having a viscosity of from 5.0 to 5,000 mPa.s at 40° C., where the R group on the T units is methyl and on average one of the three R groups on each M unit is independently selected from cyclohexyl, 2,4,4-trimethylpentyl, and norbornyl.

Siloxane composition (III) contains 33 to 80 mole percent units of formula ($R_3SiO_{1/2}$) (M units) and 67 to 20 mole percent units of formula ($SiO_{4/2}$) (Q units) having a viscosity of from 1.0 to 70,000 mPa.s at 40° C., where each R is independently selected from alkyl groups comprising 1 to 18 carbon atoms and aryl groups comprising 6 to 18 carbon atoms provided from 10 to 70 mole percent of R groups are not methyl. Although siloxane composition (III) generally contains M and Q units in each molecule, so long as it doesn't affect the object of the invention, siloxane composition (III) may also contain difunctional siloxane units (D units) represented by formula ($R_2SiO_{2/2}$).

Preferably, siloxane composition (III) contains 67.0 to 71.4 mole percent M units and 33.0 to 28.6 mole percent Q units having a viscosity of from 10.0 to 5,000 mPa.s at 40° C., where on average one of the three R groups on each M unit is independently selected from cyclohexyl, 2,4,4-trimethylpentyl, and norbornyl.

Siloxane composition (IV) contains 0 to 28 mole percent units of formula ($R_3SiO_{1/2}$) (M units), 37 to 93 mole percent units of formula ($R_2SiO_{2/2}$) (D units), and 6 to 56 mole percent units of formula ($RSiO_{3/2}$) (T units) having a viscosity of from 5.0 to 10,000 mPa.s at 40° C., where each R is independently selected from alkyl groups comprising 1 to 18 carbon atoms and aryl groups comprising 6 to 18 carbon atoms provided from 10 to 70 mole percent of R groups are not methyl and provided further that at least one of the R groups which is not methyl is chosen from alkyl groups comprising 7 to 18 carbon atoms and aryl groups comprising 7 to 18 carbon atoms.

Preferably, siloxane composition (IV) contains 0.1 to 10 mole percent M units, 40 to 55 mole percent D units and 40 to 55 mole percent T units having a viscosity of from 200 to 5,000 mPa.s at 40° C., where each R is independently selected from linear alkyl groups comprising 1 to 8 carbon atoms, branched alkyl groups comprising 4 to 18 carbon atoms, and cyclic alkyl groups comprising 5 to 18 carbon atoms provided from 10 to 50 mole percent of R groups are not methyl and provided further that at least one of the R groups which is not methyl is chosen from alkyl groups comprising 7 to 18 carbon atoms.

Siloxane composition (V) contains 1 to 100 mole percent units of formula ($R_3SiO_{1/2}$) (M units) and 99 to 0 mole percent units of formula ($R_2SiO_{2/2}$) (D units) having a viscosity of from 1.0 to 50,000 mPa.s at 40° C., where each R is independently selected from alkyl groups comprising 1 to 18 carbon atoms and aryl groups comprising 6 to 18 carbon atoms provided from 10 to 70 mole percent of R groups are not methyl and provided further that at least one of the R groups which is not methyl is chosen from alkyl groups comprising 7 to 18 carbon atoms and aryl groups comprising 7 to 18 carbon atoms.

Preferably, siloxane composition (V) contains 5.0 to 100 mole percent M units and 95 to 0 mole percent D units having a viscosity of from 3.0 to 5,000 mPa.s at 40° C., where each R is independently selected from linear alkyl groups comprising 1 to 8 carbon atoms, branched alkyl groups comprising 4 to 18 carbon atoms, and cyclic alkyl groups comprising 5 to 18 carbon atoms provided from 10 to 50 mole percent of R groups are not methyl and provided further that at least one of the R groups which is not methyl is chosen from alkyl groups comprising 7 to 18 carbon atoms.

Siloxane composition (VI) contains cyclosiloxanes of formula $(R_2SiO_{2/2})_a$ ($D_a$ units) having a viscosity of from 2.0 to 50,000 mPa.s at 40° C., where a is an integer ranging from 3 to 20, each R is independently selected from alkyl groups comprising I to 18 carbon atoms and aryl groups comprising 6 to 18 carbon atoms provided from 10 to 70 mole percent of R groups are not methyl.

Preferably, siloxane composition (VI) cyclosiloxanes of formula $(R_2SiO_{2/2})_a$ having a viscosity of from 5.0 to 50,000 mPa.s at 40° C., where a is an integer ranging from 4 to 10, each R is independently selected from linear alkyl groups comprising 1 to 8 carbon atoms, branched alkyl groups comprising 4 to 18 carbon atoms, and cyclic alkyl groups comprising 5 to 18 carbon atoms provided from 10 to 50 mole percent of R groups are not methyl.

More preferably, siloxane composition (VI) cyclosiloxanes of formula $(R_2SiO_{2/2})_a$ having a viscosity of from 5.0 to 50,000 mPa.s at 40° C., where a is an integer ranging from 4 to 6, provided from 30 to 50 mole percent of R groups are independently selected from cyclohexyl, 2,4,4-trimethylpentyl, and norbornyl.

Generally, 1 to 85 weight percent of Component (B) may be used in the present invention. Preferably, 10 to 78 weight percent of Component (B) may be used, with 25 to 70 weight percent of Component (B) being more preferable. Component (B) comprises at least one siloxane composition selected from formulas (I)–(VI) described above. Therefore, depending on the desired properties of the traction fluid, Component (B) may comprise only one of such siloxane compositions or may comprise a blend of two or more of such siloxane compositions.

The siloxane compositions useful in this invention may be prepared by methods well known in the art. The specific units in siloxane fluids (I)–(V) are basic silicon containing intermediates. The copolymerization of these units is generally accomplished by hydrolysis and subsequently the condensation of either chlorosilanes or alkoxysilanes. For example, siloxane fluids (I)–(V) may be prepared by the hydrolysis and condensation of appropriate amounts of $RSiCl_3$, $R_2SiCl_2$, $R_3SiCl$, and $SiCl_4$ where R is as described above. A review of this process can be found in "The Chemistry and Technology of Silicones," pp. 192–198, by W. Noll (1968). When using chlorosilanes as a starting material HCl is generated as a by-product and must be neutralized or otherwise removed. One can neutralize HCl using an aqueous solution of base, such as a bicarbonate or carbonate salt of a metal such as sodium or potassium or calcium, or by repeated washing with water. Both methods may also be employed together. When made from alkoxysilanes, residual alcohol can be distilled overhead. Those skilled in the art will recognize that catalysts such as minerals, acids, and bases can be used to facilitate the hydrolysis/condensation process. A neutral solvent such as toluene may also be used to facilitate the reaction. A solvent may also be used when various reactive capping agents are used to reduce residual silanols in the siloxane fluid. The solvent may then be removed by known methods such as distillation after the siloxane fluid's manufacture is complete.

R groups other than methyl can be added to the M, D, and T units either before the hydrolysis/condensation process or after. In either case, two principle routes are available to put these groups on the silicon. One involves the use of the corresponding chlorosilane and subjecting it to a Grignard process (Noll, pp 42–46). This is especially effective for adding aromatic groups to silicon, and has been industrially practiced for over 50 years. If it is preferred to eliminate the unsaturation from the molecule, hydrogenation of the aromatic group can be carried out as a second step. A variety of hydrogenation catalysts can be used to carry out the reaction such as nickel or platinum complexes.

The second process path is to add an olefin to a hydrogen function silicone material using a platinum catalyst system (Noll, pp. 50–55). Such a reaction can be carried out on the starting monomeric M, D, or T unit; or it can be carried out on a polymer or copolymer intermediate that has the correct amount of silicon hydride functionality in its structure. Depending on the olefin employed, a subsequent reaction, preferably using a $C_2$–$C_4$ olefin to remove residual Si-H, may be required. The advantage of this process path is that solvent use can be minimized, or in some cases eliminated, and the amount of residual by-products is greatly reduced. If more than one olefin is used simultaneously, one must consider whether the hydrosilation rate for each olefin is competitive with the other. If their hydrosilation rates are competitive, then a randomly functionalized copolymer will be obtained. If the olefins' hydrosilation rates differ, however, then a block type of copolymer can result unless the olefins are added sequentially so as to insure the even distribution of both olefins on to the SiH containing siloxane substrate.

Siloxane composition (VI) contains cyclosiloxanes and may be prepared by methods well known in the art.

Preferably, each of the siloxane compositions (I)–(VI) will be essentially fully condensed, however, depending on the method of manufacture, up to 20 mole percent silanol can be present in siloxane fluids (I)–(IV).

The traction fluids of the present invention comprising Components (A) and (B) may be prepared by conventional techniques and methods for blending two or more liquids. The blending can be done at room temperature or at elevated temperatures. Any preference for the method, equipment, or temperature used for blending Components (A) and (B) is a matter of convenience.

Persons skilled in the art will understand that the specific amounts of Components (A) and (B) needed will vary depending on the properties desired, the types of siloxane compositions and organic oils used and the other additives used. For example, certain other organosilicone fluids such as described in JP 6-271588, EP 0350125, U.S. Pat. No. 4,449,415 and U.S. Pat. No. 4,577,523 may be useful in this invention in addition to Components (A) and (B). Further, other ingredients which are conventionally used in traction fluids such as anti-wear agents, anti-oxidation agents, anti-rust agents, anti-foam agents, etc may be added as long as they do not interfere with the desired properties.

In a preferred embodiment of the present invention, a Component (C) comprising 1 to 40 weight percent of at least one organosilicone fluid containing 0 to 28 mole percent units of formula ($R'_3SiO_{1/2}$), 37 to 93 mole percent units of formula ($R'_2SiO_{2/2}$), and 6 to 56 mole percent units of formula ($R'SiO_{3/2}$) having a viscosity of from 5 to 10,000 mPa.s at 40° C., where each R' is independently selected from alkyl groups comprising 1 to 6 carbon atoms and phenyl is added in addition to Components (A) and (B).

The blends of the present invention are useful as traction fluids in traction drive apparatus or friction drive apparatus using rolling contact subject to varied operating temperatures. Examples of where such traction drive apparatus may be used include automobiles, industrial machinery, and helicopters.

EXAMPLES

The following Examples are merely illustrative and are not intended to limit the invention. Any reference to M, D, T, and Q units describe units of the formulae $R_3SiO_{1/2}$, $R_2SiO_{2/2}$, $RSiO_{3/2}$, and $SiO_{4/2}$ respectively, where each R group is as defined.

Test Methods:

Traction Coefficients: (a) Unless otherwise described, traction was measured using a Mini Traction Machine (MTM) Test System from PCS Instruments of London, UK. A 3/4" bearing steel (AISI 52100 grade steel) ball and a 46 mm bearing steel (AISI 52100) disk were used for these determinations. The test conditions were set at: 2 m/s disk speed, 1.25 GPa pressure, 2% slide roll, and temperatures from 0° C. to 140° C. The test chamber was disassembled and cleaned with toluene, then isopropyl alcohol, between each test run. Trace solvent was removed: from the test chamber with dry air. (b) The data in Table 7 was generated using a $WAM_{hs}$ testing machine (Wedeven Associates, Edgemont, Pa.) under conditions which varied from −40° C. to 20° C., from 2.0 to 10.0 meters per second, and from 1.5–4.0 GPa pressure at 2% Slide Roll Ratio. The test machine was equipped with a cooling unit to permit measurement of traction at temperatures as low as −40° C. The machine's disk was 102 nmn diameter and 12.7 mm thick while the ball was 20.64 mm diameter. AISI 52100 steel with a hardness of 60–63 HRC was used. In each case when the result for a traction coefficient is specified as "fluid starved" this means that the high viscosity of the tested material under these specific conditions inhibit fluid flow to the extent that a traction coefficient could not be obtained.

Molecular Weight Determinations: Gel permeation chromatography (GPC) methods were used to determine the average molecular weight of the samples prepared.

Method A: When using polystyrene as a reference standard, the samples were tested in a 0.5% concentration of the sample in THF using PL mixed C columns designed for 200–3,000,000 molecular weight with an RI detector.

Method B: When using silicone resin fractions as a reference standard, the samples were tested in a 0.5% concentration of the sample in $CHCl_3$ using PL gel 5μm Mixed-D columns designed for 200–400,000 molecular weight with an infrared detector.

Method C: When using PDMS standards, the samples were tested in a 0.5% concentration of the sample in toluene using PL gel 5μm Mixed-C columns designed for 200–2,000,000 molecular weight with an RI detector.

Viscosity The dynamic viscosity at a frequency of 10 rad $s^{-1}$ was measured using a Rheometric Scientific RDAII rheometer equipped with 50-mm-diameter parallel-plate fixtures. The samples were tested in a temperature range of −40° C. to 120° C. using a heating rate of 2° C./min, where liquid nitrogen was used to cool the test chamber.

NMR: The NMR analysis was done using a Mercury 400 mHz super conducting spectrometer. The instrument uses a silicon-free probe. Characterization of these materials was done using $^{29}Si$ and $^{13}C$ experiments. Samples were prepared using a 60/40 ratio of deuterated chloroform ($CDCl_3$) to sample material. The NMR sample contained 0.02 molar Chromium (III) acetylacetonate ($Cr(acac)_3$). This compound was used as a relaxation agent to increase the efficiency of the experiments. NMR samples were prepared in Teflon tubes to eliminate the silicon signal in the Q region that occurs with glass tubes. In most cases, the acquisition time was 1–2 hours. Similar procedures for sample preparation were also used for $^{13}C$ NMR.

Preparation of samples:

Sample A1: Into a 3-neck flask were combined 118.43 grams of cyclohexyldimethylchlorosilane, 49.33 grams of methyltrimethoxysilane, and 165.71 grams of dimethoxyethane (DME). With the materials being stirred, 22.42 grams of water were added over a two minute period. The temperature was raised to and then held at 50° C. for one hour. Solvent, water and methanol were then stripped from the silicone under vacuum at 100° C. The product from the stripping operation was then re-dissolved into 120 grams of fresh DME, 7.5 grams of water was added and then 44.76 grams of trimethylchlorosilane. The reaction was brought to 50° C. and held there for 1 hour. The DME and residual water were then stripped out under vacuum at 100° C. Toluene was used to re-dissolve the product, and then extracted with saturated aqueous $NaHCO_3$ and fresh water until the wash water pH was greater than 6. The toluene was then stripped away using a Rotovap® unit for 1 hour at 5 mm Hg. 92.4 grams of resin product was recovered. $^{13}C$ and $^{29}Si$ NMR analysis indicated the composition to be: $M(cyclohexyldimethyl)_{0.54}$ $M(trimethyl)_{0.08}$ $T(methyl)_{0.38}$ wherein the total M:T mole ratio is 1.63. The viscosity was measured as 1,260 mPa.s (−40° C.), 70 mPa.s (0° C.), 15 mPa.s (40° C.), and 5 mPa.s (10° C.). The molecular weight as determined from a 0.5% wt THF solution run through a gel permeation column using polystyrene as a reference standard was 400 (Mn) and 510 (Mw) grams per mole.

Sample A2: The same procedure was followed as for Sample A1. $^{13}C$ and $^{29}Si$ NMR analysis indicated the composition to be: $M(cyclohexyldimethyl)_{0.47}$ $M(trimethyl)_{0.12}$ $T(methyl)_{0.40}$ wherein the total M:T mole ratio is 1.48.

Sample A3: The same procedure was followed as for Sample A1. The viscosity of the fluid was measured as 1,320 mPa.s (−40° C.), 79 mPa.s (0° C.), 18 mPa.s (40° C.), and 5 mPa.s (100° C. ).

Sample A4: The same procedure was followed as for Sample A1. $^{13}C$ and $^{29}Si$ NMR analysis indicated the composition to be: $M(cyclohexyldimethyl)_{0.54}$ $M(trimethyl)_{0.06}$ $T(methyl)_{0.41}$ wherein the total M:T mole ratio is 1.46. The viscosity of the fluid was measured as 1,260 mPa.s (−40° C.), 70 mPa.s (0° C.), 15 mPa.s (40° C.), and 5 mPa.s (100° C.). The molecular weight as determined from a 0.5% wt THF solution run through a gel permeation column using polystyrene as a reference standard is 710 (Mn) and 810 (Mw) grams per mole.

Sample B: This was prepared in the same manner as Sample A1; however, instead of cyclohexyldimethylchlorosilane, 100 grams of norbornyldimethylchlorosilane was mixed with 48.11 grams of methyl trimethoxysilane. $^{13}C$ and $^{29}Si$ NMR analysis indicated the composition to be: $M(trimethyl)_{0.14}$ $M(norbornyldimethyl)_{0.48}$ $T(methyl)_{0.38}$. The viscosity was measured as 3,440 mPa.s (−40° C.), 107 mPa.s (0° C.), 21 mPa.s (40° C.), and 5 mPa.s (100° C.). The molecular weight as determined from a 0.5% wt THF solution run through a gel permeation column using polystyrene as a reference standard was 380 (Mn) and 510 (Mw) grams per mole.

Sample C: 155.15 grams of cyclohexyldimethylchlorosilane was charged to a flask, and 51.2 grams of deionized water was slowly added to hydrolyze the chlorosilane. After all the water had been added, the reaction temperature rose to 47° C. at which time 41.1 grams of toluene was added. The reaction was continued at 47–50° C. for thirty minutes, then agitation and heat removed while the two phases separated. 64.0 grams of waste aqueous acid were decanted off, then 41.1 grams of 5% aqueous $NaHCO_3$ was added. After 30 minutes of mixing the product and water phases were allowed to settle and the aqueous phase decanted. Treatment of the product layer with 5% aqueous NaHCO3 was repeated two more times. Then toluene and residual water was removed by atmospheric stripping. 129.08 grams of product was recovered. The glass transition temperature (Tg) of Sample C was determined to be −112 to −114° C. The viscosity was measured as 181 mPa.s (−40° C.); 15 mPa.s (0° C.); 4 mPa.s (40° C.), and 1 mPa.s (100° C.). GC/MS analysis indicated the major species to be dicyclohexyl, tetramethyl disiloxane having a mass number of 298. A secondary signal with mass number of 440 corresponds to 1,2,3 tricyclohexyl 1,1,2,3,3 pentamethyl trisiloxanes.

Sample D: 94.5 grams of norbornyldimethylchlorosilane was hydrolyzed using 49.0 grams of water. After one hour of reaction, the temperature of the reaction mixture had reached 56 C. 68.7 grams of heptane was then added to solubilize the product layer. After heating an additional 30 minutes at 70° C., the reaction was cooled and the product and waste acid layers allowed to separate. 60 grams of product layer was isolated from the aqueous waste HCI. Then the product phase was washed repeatedly with 10% wt aqueous $NaHCO_3$, and finally with fresh water until the water wash phase had a pH of >6.0. The product phase was then stripped in a 1 L glass flask using a condenser, nitrogen sweep, and vacuum system to 105° C. with 10–20mm Hg of vacuum. 73.8 grams of amber oil was recovered. $^{13}C$ and $^{29}Si$ NMR indicated the composition to be: 98.6 mole % $M(norbornyldimethylsiloxy)_{2.0}$, with 7.9 mole % (9.1 ppm) and 90.7 mole % (8.4 ppm) of two different conformations. GC analysis was run neat on a DB-1 capillary GC column using flame ionization detection without standards. Two major signals eluted at 13.5 and 13.6 minutes giving uncorrected area % values of 85% and 13% respectively, suggesting different conformations of the same disiloxane. The viscosity was measured as 640 mPa.s (−40° C.); 35 mPa.s (0° C.); 4 mPa.s (40° C.), and 1.6 mPa.s (100° C.).

Sample F1: A chlorosilane mixture consisting of methyltrichlorosilane, dimethyldichlorosilane and trimethylchlorosilane was hydrolysed using an excess of water and toluene as a co-solvent. Optionally, isopropanol can be used as a second solvent in addition to toluene. After the initial hydrolysis, the aqueous acid layer was decanted and repeated washing done with additional water to reduce residual acid content of the toluene phase. Additional trimethylchlorosilane was added along with only enough water to facilitate its hydrolysis, and the resin intermediate was then bodied to reduce residual silanol and to build molecular weight. $^{13}C$ and $^{29}Si$ NMR analysis indicated the composition to be: $M(trimethyl)_{0.17}$ $D(dimethyl)_{0.33}$ $T(methyl)_{0.51}$ The viscosity was measured as 3,400,000 mPa.s (−40° C.), 6,830 mPa.s (0° C.), 590 mPa.s (40° C.), and 88 mPa.s (100° C.). The molecular weight as determined from a 0.5% wt THF solution run through a gel permeation column using polystyrene as a reference standard was 875 (Mn) and 5,689 (Mw) grams per mole.

Sample F2: The same procedure was used as for Sample F1 except the bodying time was shortened to reduce molecular weight of the final product. $^{13}C$ and 29Si NMR analysis indicated the composition to be: $M(trimethyl)_{0.11}$ $D(dimethyl)_{0.36}$ $T(methyl)_{0.53}$. The viscosity was measured as 1,300,000 mPa.s (−40° C.), 3,222 mPa.s (0° C.), 312 mPa.s (40° C.), and 48 mPa.s (100° C.).

Sample F3: The same procedure was used as for Sample F1 except the bodying time was set to a time between that of Samples F1 and F2. $^{13}C$ and $^{29}Si$ NMR analysis indicated the composition to be: $M(trimethyl)_{0.11}$ $D(dimethyl)_{0.37}$ $T(methyl)_{0.52}$. The viscosity was measured as 1,700,000 mPa.s (−40° C.), 4,127 mPa.s (0° C.), 377 mPa.s (40° C.), and 62 mPa.s (100° C.).

Sample G: 510 grams of water were added to a 2-L, 3-neck round bottom flask. With mixing, a solution composed of 80.31 grams of cyclohexyldimethylchlorosilane, 118.64 grams of cyclohexyltrichlorosilane and 282.9 grams of toluene was added dropwise to the water. The addition took 20 minutes and the temperature of the reaction rose to 50 ° C. The reaction was run an additional five hours at 80 ° C., then when cool the aqueous acid layer was removed. The product layer was washed repeatedly with saturated aqueous $NaHCO_3$ and water until the water wash had a pH of 6 or greater. Enough toluene was then stripped out to yield a 40% wt solids resin solution. After titrating the product layer to determine the amount of residual HCl still present, 3% wt aqueous KOH was added so that the final concentration of KOH was 1000 ppm. The reaction was then heated to 100–110° C. and a Dean Stark Trap was used to remove water. After collecting 8.57 grams of water from the trap, the reaction was cooled and then 9.1 ml of trimethylchlorosilane was added to neutralize any residual KOH. The product solution was then washed with aqueous $NaHCO_3$ and water until pH was greater than 6. The product solution was dried over $MgSO_4$, filtered, and the toluene stripped off using a Rotovap® unit. $^{13}C$ and $^{29}Si$ NMR analysis indicated the composition to be: $M(cyclohexyldimethyl)_{0.46}$ $T(cyclohexyl)_{0.54}$. The viscosity was measured as 56,000,000 mPa.s (40° C.), 102,000 mPa.s (0° C.), 858 mPa.s (40° C.), and 61 mPa.s (100° C.). The molecular weight as determined from a 0.5% wt THF solution run through a gel permeation column using polystyrene as a reference standard was 490 (Mn) and 640 (Mw) grams per mole.

Sample H: 164.84 grams norbornene and 5.06 grams of a platinum complex suitable for hydrosilation reactions were loaded to a 1 L 3-neck reactor. Under a nitrogen purge, the norbornene was melted to 90° C. in the presence of the platinum. Then 80.80 grams MeH siloxane cyclics with a dP of 4–5 was slowly added in order to control the exothermic character of the hydrosilation reaction. Reaction temperature slowly increased to 120° C. After MeH cyclics addition was completed, an additional 6.0 grams of norbornene was added to insure an excess relative to SiH. Reaction was continued for an additional 2 hours at 120° C. Toluene was then added to reduce the viscosity so that Celite® filter aid could be used with a fritted funnel to remove the spent platinum salts. The toluene was then removed by Rotovap® at 150° C. for 1.5 hours at 5 mm Hg. The resulting fluid was amber and very viscous, but soluble in toluene as well as chloroform. $^{13}C$ and $^{29}Si$ NMR indicated the composition to be: $D(norbornylmethyl)_{0.98}$ $D(methylhydrogen)_{0.01}$ or 98.2 mole % norbornyl functionality on silicon. Example K's viscosity as a 65% solution in polyisobutylene was 130,000,000 mPa.s (−40° C.); 56,000 mPa.s (0° C.); 588 mPa.s (40° C.), 23 mPa.s (100° C.).

Sample I: A chlorosilane mixture consisting of methyltrichlorosilane, dimethyldichlorosilane and trimethylchlorosilane was hydrolysed using an excess of water and toluene as a co-solvent. Optionally, isopropanol can be used as a second solvent in addition to toluene. After the initial hydrolysis, the aqueous acid layer is decanted and repeated washing done with additional water to reduce residual acid content of the toluene phase. Additional trimethylchlorosilane is added along with only enough water to facilitate its hydrolysis, and the resin intermediate was then bodied to reduce residual silanol and to build molecular weight. $^{13}C$ and $^{29}Si$ NMR analysis indicated the composition to be:

$M(trimethyl)_{0.12}$ $D(dimethyl)_{0.50}$ $T(methyl)_{0.38}$. The viscosity of the fluid was 4,975 mPa.s (−40° C.), 280 mPa.s (0° C.), 63 mPa.s (40° C.), and 16 mPa.s (100° C.). The molecular weight as determined from a 0.5% wt THF solution run through a gel permeation column using polystyrene as a reference standard was 1,360 (Mn) and 3,362 (Mw) grams per mole.

J1: 101.8 grams of 2,4,4-trimethyl-pent-1-ene and 1.47 grams (50 ppm Pt metal) of a platinum metal complex suitable for hydrosilation reactions were mixed in a 1 liter, 3-neck flask. The reaction flask was heated to 90° C., and then 45.36 grams of MeH siloxane cyclics with a dP of 4–5 were added dropwise. The reaction mixture was heated slowly to 104° C. and held there for 2 hours. FTIR testing indicated that little, if any, SiH remained at this time. The product solution was pressure filtered through a 0.45 micron filter, then stripped using a Rotovap® to remove 16.67 g of volatiles. The yield was 119.73 g of an amber colored, transparent, low viscosity liquid. $^{13}C$ and $^{29}Si$ NMR indicated the composition to be: $D(2,4,4\text{-trimethylpentyl, methyl})_{0.97}$ with 3% or less of residual 2,4,4-trimethyl-pent-1-ene. The viscosity was measured as 22,000 mPa.s (−40° C.), 380 mPa.s (0° C.), 50 mPa.s (40° C.), and 9 mPa.s (100° C.).

Sample J2: The same procedure was followed as for Sample J1. $^{13}C$ and $^{29}Si$ NMR analysis indicated the composition to be: $D(2,4,4\text{-trimethylpentyl, methyl})_{0.98}$. The viscosity was measured as 21,500 mPa.s (−40° C.), 380 mPa.s (0° C.), 51 mPa.s (40° C.), and 9 mPa.s (100° C.).

Sample J3: The same procedure was followed as for Sample J1. $^{13}C$ and $^{29}Si$ NMR analysis indicated the composition to be: $D(2,4,4\text{-trimethylpentyl, methyl})_{0.97}$. The viscosity was measured as 20,000 mPa.s (40° C.), 343 mPa.s (0° C.), 49 mPa.s (40° C.), and 9 mPa.s (100° C.). The molecular weight as determined from a 0.5% wt THF solution run through a gel permeation column using polystyrene as a reference standard was 970 (Mn) and 1,245 (Mw) grams per mole.

Sample J4: The same procedure was followed as for Sample J1. $^{13}C$ and $^{29}Si$ NMR analysis indicated the composition to be: $D(2,4,4\text{-trimethylpentyl, methyl})_{0.96}$. The viscosity was measured as 24,000 mPa.s (−40° C.), 392 mPa.s (0° C.), 51 mPa.s (40° C.), and 8.9 mPa.s (100° C.). The molecular weight as determined from a 0.5% wt THF solution run through a gel permeation column using polystyrene as a reference standard was 980 (Mn) and 1,150 (Mw) grams per mole.

Sample K: A siloxane polymer $M(trimethyl)_{0.15}$ $D(dimethyl)_{0.62}$ $D(methylhydrogen)_{0.23}$ was reacted with camphene in the presence of a platinum complex (49.9 ppm Pt metal) in a 2 liter Parr Reactor. The reactor was heated to 90° C. and 20 psi pressure. After twenty hours, $^{29}Si$ NMR indicated the majority of the SiH in the siloxane polymer had been reacted. Excess camphene was then stripped out using a rotary evaporator. Ethylene gas was then introduced and the remaining SiH consumed over 2.5 hours up to a maximum reaction temperature of 130° C. and a maximum pressure of 101 psi. The crude was then stripped using a rotary evaporator to 100° C. under a reduced pressure of <2 mm Hg. $^{13}C$ and $^{29}Si$ NMR analysis indicated the composition to be: $D(dimethyl)_{0.60}$ $D(camphyl, methyl)_{0.24}$ $D(ethyl, methyl)_{0.04}$ $M(trimethyl)_{0.14}$. The viscosity was measured as 5,239 mPa.s (−40° C.), 296 mPa.s (0° C.), 62 mPa.s (40° C.), and 11 mPa.s (100° C.). The molecular weight as determined from a 0.5% wt THF solution run through a gel permeation column using polystyrene as a reference standard was 959 (Mn) and 1,816 (Mw) grams per mole.

Sample L: 230 grams of cyclohexene and 625.6 grams of siloxane polymer $M(trimethyl)_{0.15}$ $D(dimethyl)_{0.62}$ $D(methylhydrogen)_{0.23}$ were added to a 2 liter Parr Reactor. 8.63 grams of a platinum complex (49.9 ppm Pt metal) was added. The reactor was heated to 90° C. and 20 psi pressure. After twenty hours, the reaction temperature had risen to 138° C. and 25 psi pressure. $^{29}Si$ NMR indicated 97+% of the SiH in the siloxane polymer had been reacted. Excess cyclohexene was then stripped out using a rotary evaporator. Ethylene gas was then introduced and the remaining SiH consumed over 2.5 hours up to a maximum reaction temperature of 130° C. and a maximum pressure of 101 psi. The crude was then stripped using a rotary evaporator to 100° C. under a reduced pressure of <2 mm Hg yielding 717 grams polymer. $^{13}C$ and $^{29}Si$ NMR analysis indicated the composition to be: $D(dimethyl)_{0.61}$ $D(cyclohexylmethyl)_{0.26}$ $M(trimethyl)_{0.13}$. The viscosity was measured as 1,070 mPa.s (−40° C.), 113 mPa.s (0° C.), 32 mPa.s (40° C.), and 10 mPa.s (100° C.).

Sample M: To a flask were charged 58.88 grams of tetraethylorthosilicate, 100 grams of cyclohexyldimethylchlorosilane and 140.1 grams of dimethoxyethane (DME). Over a two-minute period, 21.65 g of water was added resulting in an exotherm to 50° C. The reaction was continued for 1 hour at 50° C., then DME and by-product HCI was stripped out at 50° C. and 0.5 mm Hg. The stripped residues were re-dissolved into 140 grams of fresh DME and 9.29 grams of water also were added. Trimethylchlorosilane (55.31 grams) was added and the reactor contents heated for 1 hour at 50° C. Then the product solution was stripped on a Rotovap® unit at 90° C. and 0.5 mm Hg for 2 hours. The product crude was re-dissolved in toluene and rinsed with alternating washes of saturated aqueous $NaHCO_3$ and water until the water wash was neutral pH. The toluene product phase was then dried over $MgSO_4$, filtered, and the toluene removed by stripping on a Rotovap® unit. A clear oil was recovered. $^{13}C$ and $^{29}Si$ NMR analysis indicated the composition to be: $M(cyclohexyldimethyl)_{0.57}$ $M(trimethyl)_{0.11}$ $Q_{0.35}$. The viscosity was measured as 7,267 mPa.s (−40° C.), 237 mPa.s (0° C.), 42 mPa.s (40° C.), and 10 mPa.s (100° C.). The molecular weight as determined from a 0.5% wt THF solution run through a gel permeation column using polystyrene as a reference standard was 590 (Mn) and 700 (Mw) grams per mole.

Organic Oil 1: A $C_{10}$ alpha olefin dimer designated PAO 2 cst (2 mPa.s) obtained from Chevron Phillips Chemical Company, LP., Houston, Tex. The viscosity was measured as 250 mPa.s (−40° C.), 16 mPa.s (0° C.), 5 mPa.s (40° C.), and 2 mPa.s (100° C.).

Organic Oil 2: (A) (Organic Oil 2A): a bicyclo (2.2.1) heptane methylene dimer (bis-methyl substituted norbornyl methane) available as Nissan KTF-1 Extroid® CVT fluid. The viscosity was measured as 216,000 mPa.s (−40° C.), 354 mPa.s (0° C.), 29 mPa.s (40° C.), and 4 mPa.s (100° C.). (B) (Organic Oil 2B): a different lot of the above material having a viscosity of 156,000 mPa.s (−40° C.), 365 mPa.s (0° C.), 30 mPa.s (40° C.), and 4.5 mPa.s (100° C.).

Organic Oil 3: A hydrogenated styrene dimer (2,4 dicyclohexyl-2-methylpentane) available under the trade name of Santotrac® 50 from Findett Corporation, St. Louis, Mo. The viscosity was measured as 407,000 mPa.s (−40° C.), 385 mPa.s (0° C.), 22 mPa.s (40° C.), and 4 mPa.s (100° C.).

Organic Oil 4: A hydrogenated naphthenic oil available as Pale® 40 oil from Diamond Shamrock Refining Company, LP., Houston, Tex. The viscosity was measured as 385 mPa.s (−40° C.), 14 mPa.s (0° C.), 3 mPa.s (40° C.), and 1 mPa.s (100° C.).

Organic Oil 5: An unsaturated polyisobutylene based polymer having a molecular weight (Mn) of 370 as measured by GPC methods, available from the Amoco Chemical Company, Chicago, Ill. under the trade name Indopol® L14. The viscosity was measured as 143,000 mPa.s (−40° C.), 350 mPa.s (0° C.), 22 mPa.s (40° C.), and 3 mPa.s (100° C.).

Organic Oil 6: A hydrogenated polyisobutylene based polymer having an average molecular weight (Mn) of 370 as measured by GPC methods, available from the Amoco Chemical Company, Chicago, Ill. under the trade name Indopol® L14E. The viscosity was measured as 27 mPa.s (38° C.).

EXAMPLES 1–34

Blends of siloxane compositions and organic oils as described in Samples A through M and Organic Oils 1 through 6 were blended at room temperature with low shear mixing to generate various traction fluids. These blends were then compared to the properties of various organic oils. Typically, a minimum of 50 grams of the traction fluid was prepared. The blends are listed as Examples 1 through 34 and their specific compositions are provided in Tables 1 through 7 along with the results of traction coefficient and viscosity testing.

TABLE 1

Effect of Addition of 10 Wt. % of Various Samples to Organic Oil 2A

| Example | Sample | Weight % Sample | Wt. % Organic Oil 2 | Traction Coefficient 0° C. | Traction Coefficient 120° C. | % Traction Change Org. Oil 2 at . . . 0° C. | % Traction Change Org. Oil 2 at . . . 120° C. | Viscosity (−40° C.) mPa · s | % Viscosity Reduction vs Org Oil 2 |
|---|---|---|---|---|---|---|---|---|---|
| 1 | A2 | 10 | 90 | 0.1074 | 0.0708 | 2.2 | −2.9 | 95,000 | 56 |
| 2 | D | 10 | 90 | 0.1057 | 0.0692 | 0.6 | −5.1 | 80,000 | 63 |
| 3 | Organic Oil 1* | 10 | 90 | 0.1009 | 0.0581 | −4.0 | −20.3 | 46,000 | 79 |
| 4 | C* | 10 | 90 | 0.1070 | 0.0687 | 1.8 | −5.8 | 54,200 | 75 |
| | Organic Oil 2A* | 0 | 100 | 0.1051 | 0.0729 | — | — | 216,000 | — |

*Comparative

TABLE 2

Effect of Addition of 25 Wt. % of Various Samples to Organic Oil 2A

| Example | Sample | Weight % Sample | Wt. % Organic Oil 2 | Traction Coefficient 0° C. | Traction Coefficient 120° C. | % Traction Change vs Org. Oil 2 at . . . 0° C. | % Traction Change vs Org. Oil 2 at . . . 120° C. | Viscosity (−40° C.) mPa · s | % Viscosity Reduction vs Org Oil 2 |
|---|---|---|---|---|---|---|---|---|---|
| 5 | A2 | 25 | 75 | 0.1094 | 0.0690 | 4.1 | −5.3 | 32,000 | 85 |
| 6 | Organic Oil 1* | 25 | 75 | 0.0924 | 0.0388 | −12.1 | −46.7 | 6,000 | 97 |
| | Organic Oil 2A* | 0 | 100 | 0.1051 | 0.0729 | — | — | 216,000 | — |

*Comparative

TABLE 3

Effect of Addition of 10 Wt. % of Various Samples to Organic Oil 3

| Example | Sample | Weight % Sample | Wt. % Organic Oil 3 | Traction Coefficient 0° C. | Traction Coefficient 120° C. | % Traction Change vs Org. Oil 3 at . . . 0° C. | % Traction Change vs Org. Oil 3 at . . . 120° C. | Viscosity (−40° C.) mPa · s | % Viscosity Reduction vs Org Oil 3 |
|---|---|---|---|---|---|---|---|---|---|
| 7 | A2 | 10 | 90 | 0.1103 | 0.0708 | 1.3 | −4.1 | 228,000 | 44 |
| 8 | B | 10 | 90 | 0.1088 | 0.0710 | −0.1 | −3.8 | 191,000 | 53 |
| 9 | M | 10 | 90 | 0.1101 | 0.0709 | 1.1 | −3.9 | 189,500 | 53 |
| 11 | D | 10 | 90 | 0.1101 | 0.0692 | 1.1 | −6.3 | 164,000 | 60 |
| 12 | J1 | 10 | 90 | 0.1090 | 0.0731 | 0.1 | −0.9 | 345,000 | 15 |
| 13 | K | 10 | 90 | 0.1083 | 0.0729 | −0.6 | −1.2 | 151,000 | 63 |
| 14 | L* | 10 | 90 | 0.1092 | 0.0690 | 0.3 | −6.5 | 142,000 | 65 |
| 10 | C* | 10 | 90 | 0.1118 | 0.0691 | 2.7 | −6.4 | 104,000 | 74 |
| 15 | Organic Oil 1* | 10 | 90 | 0.1048 | 0.0568 | −3.8 | −23.1 | 65,000 | 84 |
| 16 | Organic Oil 4* | 10 | 90 | 0.1076 | 0.0678 | −1.2 | −8.1 | 155,000 | 62 |
| | Organic Oil 3* | 0 | 100 | 0.1089 | 0.0738 | — | — | 407,000 | — |

*Comparative

TABLE 4

Effect of Addition of 25 Wt. % of Various Samples to Organic Oil 3

| Example | Sample | Weight % Sample | Wt. % Organic Oil 3 | Traction Coefficient 0° C. | Traction Coefficient 120° C. | % Traction Change vs Org. Oil 3 at . . . 0° C. | % Traction Change vs Org. Oil 3 at . . . 120° C. | Viscosity (−40° C.) mPa · s | % Viscosity Reduction vs Org Oil 3 |
|---|---|---|---|---|---|---|---|---|---|
| 17 | A2 | 25 | 75 | 0.1123 | 0.0681 | 3.1 | −7.7 | 90,000 | 78 |
| 18 | B | 25 | 75 | 0.1106 | 0.0671 | 1.6 | −9.1 | 89,800 | 78 |
| 19 | J1 | 25 | 75 | 0.1097 | 0.0691 | 0.7 | −6.3 | 124,200 | 69 |
| 20 | Organic Oil 4* | 25 | 75 | 0.1056 | 0.0619 | −3.0 | −16.1 | 48,300 | 88 |
| | Organic Oil 3* | 0 | 100 | 0.1089 | 0.0738 | — | — | 407,000 | — |

*Comparative

TABLE 5

Compositions of Examples 21–34 with all Values as Weight Percent

| Example | Organic Oil 2B | Organic Oil 4 | Organic Oil 5 | Organic Oil 6 | Samples A1 | A2 | A3 | A4 | F1 | F2 | F3 | G | H | I | J1 | J2 | J4 |
|---|---|---|---|---|---|---|---|---|---|---|---|---|---|---|---|---|---|
| 21 | | | 60.0 | | | | | | 40.0 | | | | | | | | |
| 22 | | | 60.0 | | | | | | 20.0 | | | | | 20.0 | | | |
| 23 | | | 54.0 | | 10.0 | | | | 36.0 | | | | | | | | |
| 24 | | | 54.0 | | 10.0 | | | | | | | 36.0 | | | | | |
| 25 | | | 36.0 | | 10.0 | | | | 36.0 | | | | | 18.0 | | | |
| 26 | | | 36.0 | | | | 10.0 | | | | 36.0 | | | | 18.0 | | |
| 27 | | | 30.0 | | | | 25.0 | | | | | | 15.0 | | | 30.0 | |
| 28 | | | 30.0 | | | 25.0 | | | | 15.0 | | | | | | 30.0 | |
| 29 | | 5.0 | 25.0 | | | | | 15.0 | | 30.0 | | | | | | 25.0 | |
| 30 | | 4.8 | 23.9 | | | | | 14.4 | | 33.0 | | | | | | 23.9 | |
| 31 | | 4.6 | 22.8 | | | | | 13.8 | | 36.0 | | | | | | 22.8 | |
| 32 | | | 34.4 | | | | | 14.0 | | | 34.4 | | | | | | 17.2 |
| 33 | | | | 34.1 | | | | 13.6 | | | 34.1 | | | | | | 18.2 |
| 34 | 80 | | | | | | | 20 | | | | | | | | | |

TABLE 6

Blends Traction Performance v. Organic Oil 5

| Example | Viscosity −40° C. (mPa · s) | % Viscosity Reduction vs Org Oil 5 | Traction Coefficient 0° C. | Traction Coefficient 120° C. | % Traction Change vs Org Oil 5 at . . . 0° C. | % Traction Change vs Org Oil 5 at . . . 120° C. |
|---|---|---|---|---|---|---|
| 23 | 121,900 | 15 | 0.0989 | 0.0635 | 3.8 | 27.0 |
| 24 | 231,000 | −62 | 0.0980 | 0.0646 | 2.8 | 29.3 |
| 25 | 70,700 | 51 | 0.1013 | 0.0655 | 6.3 | 31.0 |
| 26 | 78,000 | 45 | 0.0995 | 0.0620 | 4.4 | 24.0 |
| 27 | 56,000 | 61 | 0.0982 | 0.0613 | 3.0 | 22.6 |
| 28 | 21,000 | 85 | 0.1031 | 0.0571 | 8.2 | 14.2 |
| 29 | 28,300 | 80 | 0.1018 | 0.0603 | 6.8 | 20.6 |
| 30 | 33,460 | 77 | 0.1012 | 0.0609 | 6.2 | 21.7 |
| 31 | 38,500 | 73 | 0.1008 | 0.0611 | 5.8 | 22.2 |
| 32 | 69,260 | 52 | 0.0988 | 0.0625 | 3.7 | 25.0 |
| 21* | 215,300 | −51 | ** | 0.0614 | — | 22.8 |
| 22* | 83,700 | 41 | 0.0983 | 0.0583 | 3.1 | 16.6 |
| Organic Oil 5* | 143,000 | — | 0.0953 | 0.0500 | — | — |

*Comparative
**sample not tested

TABLE 7

Low Temperature Traction of Blends vs. Organic Oil 2B

| Example | Traction Coefficient −40° C. | Traction Coefficient −20° C. | Traction Coefficient 0° C. | Traction Coefficient 20° C. | % Traction Coefficient Change v. Org Oil 2B at . . . −40° C. | % Traction Coefficient Change v. Org Oil 2B at . . . −20° C. | % Traction Coefficient Change v. Org Oil 2B at . . . 0° C. | % Traction Coefficient Change v. Org Oil 2B at . . . 20° C. | Test Conditions Test Speed meters/sec | Test Conditions Pressure GPa | Viscosity −40° C. (mPa · s) | % Viscosity Reduction vs Org Oil 2B |
|---|---|---|---|---|---|---|---|---|---|---|---|---|
| 34 | 0.0500 | 0.0960 | 0.1130 | 0.1100 | — | 20.00 | −2.59 | −4.76 | 2 | 1.5 | 59,250 | 62 |
| 33 | 0.0650 | 0.1090 | 0.1130 | 0.1120 | — | 36.25 | −2.59 | −3.03 | 2 | 1.5 | 69,260 | 56 |
| Org Oil 2B* | Fluid Starved** | 0.0800 | 0.1160 | 0.1155 | | | | | 2 | 1.5 | 156,000 | |
| 34 | 0.0350 | 0.0380 | 0.0800 | 0.0955 | — | −28.30 | −8.05 | −3.54 | 10 | 1.5 | 59,250 | 62 |
| 33 | 0.0390 | 0.0710 | 0.0890 | 0.1010 | — | 33.96 | 2.30 | 0.02 | 10 | 1.5 | 69,260 | 56 |
| Org Oil 2B* | Fluid Starved** | 0.0530 | 0.0870 | 0.0990 | | | | | 10 | 1.5 | 156,000 | |
| 34 | 0.0810 | 0.1060 | 0.1080 | 0.1100 | — | 2.91 | 1.89 | 4.76 | 2 | 4.0 | 59,250 | 62 |
| 33 | 0.1040 | 0.1120 | 0.1140 | 0.1140 | — | 8.74 | 7.55 | 8.57 | 2 | 4.0 | 69,260 | 56 |
| Org Oil 2B* | Fluid | 0.1030 | 0.1060 | 0.1050 | | | | | 2 | 4.0 | 156,000 | |

TABLE 7-continued

Low Temperature Traction of Blends vs. Organic Oil 2B

| Example | Traction Coefficient −40° C. | Traction Coefficient −20° C. | Traction Coefficient 0° C. | Traction Coefficient 20° C. | % Traction Coefficient Change v. Org Oil 2B at . . . −40° C. | % Traction Coefficient Change v. Org Oil 2B at . . . −20° C. | % Traction Coefficient Change v. Org Oil 2B at . . . 0° C. | % Traction Coefficient Change v. Org Oil 2B at . . . 20° C. | Test Conditions Test Speed meters/sec | Test Conditions Pressure GPa | Viscosity −40° C. (mPa · s) | % Viscosity Reduction vs Org Oil 2B |
|---|---|---|---|---|---|---|---|---|---|---|---|---|
| | Starved** | | | | | | | | | | | |
| 34 | 0.0820 | 0.0920 | 0.1010 | 0.1000 | — | 0.00 | 3.06 | −0.99 | 10 | 4.0 | 59,250 | 62 |
| 33 | 0.0950 | 0.1060 | 0.1030 | 0.1050 | — | 15.22 | 5.10 | 3.96 | 10 | 4.0 | 69,260 | 56 |
| Org Oil 2B* | Fluid | 0.0920 | 0.0980 | 0.1010 | | | | | 10 | 4.0 | 156,000 | |
| | Starved** | | | | | | | | | | | |

*Comparative
**Sample not tested due to high viscosity

We claim:

1. A traction fluid comprising:

(A) 15 to 99 weight percent of at least one organic oil; and (B) 1 to 85 weight percent of at least one siloxane composition chosen from;

(I) 33 to 80 mole percent units of formula ($R3SiO_{1/2}$), 0.2 to 66.8 mole percent units of formula ($RSiO_{3/2}$), and 66.8 to 0.2 mole percent units of formula ($SiO_{4/2}$) having a viscosity of from 1.0 to 50,000 mPa.s at 40° C., where each R is independently selected from alkyl groups comprising 1 to 18 carbon atoms and aryl groups comprising 6 to 18 carbon atoms provided from 10 to 70 mole percent of R groups are not methyl;

(II) 33 to 75 mole percent units of formula ($R_3SiO_{1/2}$) and 67 to 25 mole percent units of formula ($RSiO_{3/2}$) having a viscosity of from 2.0 to 20,000 mPa.s at 40° C., where each R is independently selected from alkyl groups comprising 1 to 18 carbon atoms and aryl groups comprising 6 to 18 carbon atoms provided from 10 to 70 mole percent of R groups are not methyl;

(III) 33 to 80 mole percent units of formula ($R_3SiO_{1/2}$) and 67 to 20 mole percent units of formula ($SiO_{4/2}$) having a viscosity of from 1.0 to 70,000 mPas at 40° C., where each R is independently selected from alkyl groups comprising 1 to 18 carbon atoms and aryl groups comprising 6 to 18 carbon atoms provided from 10 to 70 mole percent of R groups are not metbyl; and (VI) cyclosiloxanes of formula $(R_2SiO_{2/2})_a$ having a viscosity of from 2.0 to 50,000 mPa.s at 40° C., where a is an integer ranging from 3 to 20, each R is independently selected from alkyl groups comprising 1 to 18 carbon atoms and aryl groups comprising 6 to 18 carbon atoms provided from 10 to 70 mole percent of R groups are not methyl.

2. The traction fluid of claim 1 where Component (A) comprises at least one organic oil chosen from unsaturated polybutene, unsaturated polyisobutylene, hydrogenated polyisobutylene, 2,4 dicyclohexyl-2-methylpentane, bis-methyl substituted norbornyl methane, esters of cyclohexyl carboxylic acid and cyclohexanol, esters of cyclohexyl carboxylic acid and polyols, and esters of cyclohexanol and dicarboxylic acids.

3. The traction fluid of claim 1 where Component (A) comprises at least one organic oil chosen from hydrogenated polyisobutylene, 2,4 dicyclohexyl-2-methylpentane, and bis-methyl substituted norbornyl methane.

4. The traction fluid of claim 1 where Component (B) comprises at least one siloxane composition chosen from (II), (III), and (VI).

5. The traction fluid of claim 1 where Component (B) comprises at least one siloxane composition chosen from (II) and (VI).

6. The traction fluid of claim 1 comprising (A) 22 to 90 weight percent of at least one organic oil chosen from unsaturated polybutene, unsaturated polyisobutylene, hydrogenated polyisobutylene, 2,4 dicyclohexyl-2-methylpentane, bis-methyl substituted norbornyl methane, esters of cyclohexyl carboxylic acid and cyclohexanol, esters of cyclohexyl carboxylic acid and polyols, and esters of cyclohexanol and dicarboxylic acids; and (B) 88 to 10 weight percent of at least one siloxane composition chosen from:

(II) 33 to 67 mole percent ($R_3SiO_{1/2}$) units and 67 to 33 mole percent ($RSiO_{3/2}$) units having a viscosity of from 5.0 to 20,000 mPa.s at 40° C., where each R is independently selected from linear alkyl groups comprising 1 to 8 carbon atoms, branched alkyl groups comprising 4 to 18 carbon atoms, and cyclic alkyl groups comprising 5 to 18 carbon atoms provided from 15 to 60 mole percent of R groups are not methyl, (III) 67.0 to 71.4 mole percent ($R_3SiO_{1/2}$) units and 33.0 to 28.6 mole percent ($SiO_{4/2}$) units having a viscosity of from 10.0 to 5,000 mPa.s at 40° C., where on average one of the three R groups on each ($R_3SiO_{1/2}$) unit is independently selected from cyclohexyl, 2,4,4-trimethylpentyl, and norbornyl, and (VI) cyclosiloxanes of formula $(R_2SiO_{2/2})_a$ units having a viscosity of from 5.0 to 50,000 mPa.s at 40° C., where a is an integer ranging from 4 to 10, each R is independently selected from linear alkyl groups comprising 1 to 8 carbon atoms, branched alkyl groups comprising 4 to 18 carbon atoms, and cyclic alkyl groups comprising 5 to 18 carbon atoms provided from 10 to 50 mole percent of R groups are not methyl.

7. The, traction fluid of claim 1 comprising (A) 30 to 75 weight percent of at least one organic oil chosen from hydrogenated polyisobutylene, 2,4 dicyclohexyl-2-methylpentane, and bis-methyl substituted norbornyl methane; and (B) 70 to 25 weight percent of at least one siloxane composition chosen from:

(II) 50 to 67 mole percent ($R_3SiO_{1/2}$) units and 50 to 33 mole percent ($RSiO_{3/2}$) units having a viscosity of from 5.0 to 5,000 mPa.s at 40° C., where the R group on the ($RSiO_{3/2}$) units is methyl and on average one of the three R groups on each ($R_3SiO_{1/2}$) unit is independently selected from cyclohexyl, 2,4,4-trimethylpentyl, and norbornyl, and (VI) cyclosiloxanes of formula $(R_2SiO_{2/2})_a$ units having a viscosity of from 5.0 to 50,000 mPa.s at 40° C., where a is an integer ranging from 4 to 6, provided from 30 to 50 mole percent of R groups are independently selected from cyclohexyl, 2,4,4-trimethylpentyl, and norbornyl.

8. A traction drive system having at least two relatively rotatable members in a torque transmitting relationship and the traction fluid of claim 1 disposed on the tractive surfaces of the members.

9. The traction fluid of claim 1, further comprising (C) 1 to 40 weight percent of at least one organosilicon fluid containing 0 to 28 mole percent units of formula ($R'_3SiO_{1/2}$), 37 to 93 mole percent units of formula ($R'_2SiO_{2/2}$), and 6 to 56 mole percent units of formula ($R'SiO_{3/2}$) having a viscosity of from 5 to 10,000 mPa.s at 40° C., where each R' is independently selected from alkyl groups comprising 1 to 6 carbon atoms and phenyl.

10. The traction fluid of claim 7, further comprising (C) 1 to 40 weight percent of at least one organosilicon fluid containing 0 to 28 mole percent units of formula ($R'_3SiO_{1/2}$), 37 to 93 mole percent units of formula ($R'_2SiO_{2/2}$), and 6 to 56 mole percent units of formula ($R'SiO_{3/2}$) having a viscosity of from 5 to 10,000 mPa.s at 40° C., where each R' is independently selected from alkyl groups comprising 1 to 6 carbon atoms and phenyl.

11. A method of making a traction fluid comprising the step of mixing:

(A) 15 to 99 weight percent of at least one organic oil; and (B) 1 to 85 weight percent of at least one siloxane composition chosen from;

(I) 33 to 80 mole percent units of formula ($R_3SiO_{1/2}$), 0.2 to 66.8 mole percent units of formula ($RSiO_{3/2}$), and 66.8 to 0.2 mole percent units of formula ($SiO_{4/2}$) having a viscosity of from 1.0 to 50,000 mPa.s at 40° C., where each R is independently selected from alkyl groups comprising 1 to 18 carbon atoms and aryl groups comprising 6 to 18 carbon atoms provided from 10 to 70 mole percent of R groups are not methyl;

(II) 33 to 75 mole percent units of formula ($R_3SiO_{1/2}$) and 67 to 25 mole percent units of formula ($RSiO_{3/2}$) having a viscosity of from 2.0 to 20,000 mPa.s at 40° C., where each R is independently selected from alkyl groups comprising 1 to 18 carbon atoms and aryl groups comprising 6 to 18 carbon atoms provided from 10 to 70 mole percent of R groups are not methyl;

(III) 33 to 80 mole percent units of formula ($R_3SiO_{1/2}$) and 67 to 20 mole percent units of formula ($SiO_{4/2}$) having a viscosity of from 1.0 to 70,000 mPa.s at 40° C., where each R is independently selected from alkyl groups comprising 1 to 18 carbon atoms and aryl groups comprising 6 to 18 carbon atoms provided from 10 to 70 mole percent of R groups are not methyl; and (VI) cyclosiloxanes of formula $(R_2SiO_{2/2})_a$ having a viscosity of from 2.0 to 50,000 mPa.s at 40° C., where a is an integer ranging from 3 to 20, each R is independently selected from alkyl groups comprising 1 to 18 carbon atoms and aryl groups comprising 6 to 18 carbon atoms provided from 10 to 70 mole percent of R groups are not methyl.

12. The method of claim 11 where Component (A) comprises at least one organic oil chosen from unsaturated polybutene, unsaturated polyisobutylene, hydrogenated polyisobutylene, 2,4 dicyclohexyl-2-methylpentane, bismethyl substituted norbornyl methane, esters of cyclohexyl carboxylic acid and cyclohexanol, esters of cyclohexyl carboxylic acid and polyols, and esters of cyclohexanol and dicarboxylic acids.

13. The method of claim 11 where Component (B) comprises at least one siloxane composition chosen from (II), (III), and (VI).

14. The method of claim 11 where Component (B) comprises at least one siloxane composition chosen from (II) and (VI).

15. A traction fluid comprising:

(A) 15 to 99 weight percent of at least one organic oil other than unsaturated polybutene, unsaturated polyisobutylene, and hydrogenated polyisobutylene; and (B) 1 to 85 weight percent of at least one siloxane composition chosen from;

(I) 33 to 80 mole percent units of formula ($R_3SiO_{1/2}$), 0.2 to 66.8 mole percent units of formula ($RSiO_{3/2}$), and 66.8 to 0.2 mole percent units of formula ($SiO_{4/2}$) having a viscosity of from 1.0 to 50,000 mpa.s at 40° C., where each R is independently selected from alkyl groups comprising 1 to 18 carbon atoms and aryl groups comprising 6 to 18 carbon atoms provided from 10 to 70 mole percent of R groups are not methyl;

(II) 33 to 75 mole percent units of formula ($R_3SiO_{1/2}$) and 67 to 25 mole percent units of formula ($RSiO_{3/2}$) having a viscosity of from 2.0 to 20,000 mPas at 40° C., where each R is independently selected from alkyl groups comprising 1 to 18 carbon atoms and aryl groups comprising 6 to 18 carbon atoms provided from 10 to 70 mole percent of R groups are not methyl;

(III) 33 to 80 mole percent units of formula ($R_3SiO_{1/2}$) and 67 to 20 mole percent units of formula ($SiO_{4/2}$) having a viscosity of from 1.0 to 70,000 maP.s at 40° C., where each R is independently selected from alkyl groups comprising 1 to 18 carbon atoms and aryl groups comprising 6 to 18 carbon atoms provided from 10 to 70 mole percent of R groups are not methyl;

(IV) 0 to 28 mole percent units of formula ($R_3SiO/_{1/2}$), 37 to 93 mole percent units of formula ($R_2SiO_{2/2}$), and 6 to 56 mole percent units of formula ($RSiO_{3/2}$) having a viscosity of from 5.0 to 10,000 mPa.s at 40° C., where each R is independently selected from alkyl groups comprising 1 to 18 carbon atoms and aryl groups comprising 6 to 18 carbon atoms provided from 10 to 70 mole percent of R groups are not methyl and provided further that at least one of the R groups which is not methyl is chosen from alkyl groups comprising 7 to 18 carbon atoms and aryl groups comprising 7 to 18 carbon atoms;

(V) 1 to 100 mole percent units of formula ($R_3SiO_{1/2}$) and 99 to 0 mole percent units of formula ($R_2SiO_{2/2}$) having a viscosity of from 1.0 to 50,000 mPa.s at 40° C., where each R is independently selected from alkyl groups comprising 1 to 18 carbon atoms and aryl groups comprising 6 to 18 carbon atoms provided from 10 to 70 mole percent of R groups are not methyl and provided further that at least one of the R groups which is not methyl is chosen from alkyl groups comprising 7 to 18 carbon atoms and aryl groups comprising 7 to 18 carbon atoms; and (VI) cyclosiloxanes of formula $(R_2SiO_{2/2})_a$ having a viscosity of from 2.0 to 50,000 mPa.s at 40° C., where a is an integer ranging from 3 to 20, each R is independently selected from alkyl groups comprising 1 to 18 carbon atoms and aryl groups comprising 6 to 18 carbon atoms provided from 10 to 70 mole percent of R groups are not methyl.

16. A method of making a traction fluid comprising the step of mixing:

(A) 15 to 99 weight percent of at least one organic oil other than unsaturated polybutene, unsaturated polyisobutylene, and hydrogenated polyisobutylene; and (B) 1 to 85 weight percent of at least one siloxane composition chosen from;

(I) 33 to 80 mole percent units of formula ($R_3SiO_{1/2}$), 0.2 to 66.8 mole percent units of formula ($RSiO_{3/2}$), and 66.8 to 0.2 mole percent units of formula ($SiO_{4/2}$) having a viscosity of from 1.0 to 50,000 mPa.s at 40° C., where each R is independently selected from alkyl groups comprising 1 to 18 carbon atoms and aryl groups comprising 6 to 18 carbon atoms provided from 10 to 70 mole percent of R groups are not methyl;

(II) 33 to 75 mole percent units of formula ($R_3SiO_{1/2}$) and 67 to 25 mole percent units of formula ($RSiO_{3/2}$) having a viscosity of from 2.0 to 20,000 mPa.s at 40° C., where each R is independently selected from alkyl groups comprising 1 to 18 carbon atoms and aryl groups comprising 6 to 18 carbon atoms provided from 10 to 70 mole percent of R groups are not methyl;

(III) 33 to 80 mole percent units of formula ($R_3SiO_{1/2}$) and 67 to 20 mole percent units of formula ($SiO_{4/2}$) having a viscosity of from 1.0 to 70,000 mPa.s at 40° C., where each R is independently selected from alkyl groups comprising 1 to 18 carbon atoms and aryl groups comprising 6 to 18 carbon atoms provided from 10 to 70 mole percent of R groups are not methyl;

(IV) 0 to 28 mole percent units of formula ($R_3SiO/_{1/2}$), 37 to 93 mole percent units of formula ($R_2SiO_{2/2}$), and 6 to 56 mole percent units of formula ($RSiO_{3/2}$) having a viscosity of from 5.0 to 10,000 rnPa.s at 40° C., where each R is independently selected from alkyl groups comprising 1 to 18 carbon atoms and aryl groups comprising 6 to 18 carbon atoms provided from 10 to 70 mole percent of R groups are not methyl and provided further that at least one of the R groups which is not methyl is chosen from alkyl groups comprising 7 to 18 carbon atoms and aryl groups comprising 7 to 18 carbon atoms;

(V) 1 to 100 mole percent units of formula ($R_3SiO_{1/2}$) and 99 to 0 mole percent units of formula ($R_2SiO_{2/2}$) having a viscosity of from 1.0 to 50,000 mPa.s at 40° C., where each R is independently selected from alkyl groups comprising 1 to 18 carbon atoms and aryl groups comprising 6 to 18 carbon atoms provided from 10 to 70 mole percent of R groups are not methyl and provided further that at least one of the R groups which is not methyl is chosen from alkyl groups comprising 7 to 18 carbon atoms and aryl groups comprising 7 to 18 carbon atoms; and (VI) cyclosiloxanes of formula $(R2SiO_{2/2})_a$ having a viscosity of from 2.0 to 50,000 mPa.s at 40° C., where a is an integer ranging from 3 to 20, each R is independently selected from alkyl groups comprising 1 to 18 carbon atoms and aryl groups comprising 6 to 18 carbon atoms provided from 10 to 7b mole percent of R groups are not methyl.

* * * * *